US005632574A

United States Patent [19]

Klaymar et al.

[11] Patent Number: 5,632,574

[45] Date of Patent: May 27, 1997

[54] BACKFILLING DEVICE AND APPARATUS THEREFOR

[75] Inventors: Edward J. Klaymar, Indiana, Pa.; Alain Lebaigue, Fresnoy en Thelle; Jean M. Meteye, Puiseux le Hauberger, both of France

[73] Assignee: KNI Incorporated, Homer City, Pa.

[21] Appl. No.: 539,226

[22] Filed: Oct. 4, 1995

[30] Foreign Application Priority Data

Oct. 31, 1994 [FR] France ..... 94 13032

[51] Int. Cl.[6] ..... F16L 1/028

[52] U.S. Cl. ..... 405/179; 405/154; 405/161; 405/174

[58] Field of Search ..... 405/157, 159–164, 405/174–176, 179, 180, 183, 154

[56] References Cited

U.S. PATENT DOCUMENTS

| | | | |
|---|---|---|---|
| 3,339,369 | 9/1967 | Ryan | 405/157 |
| 3,460,350 | 8/1969 | Speiser et al. | 405/183 |
| 3,849,999 | 11/1974 | Coffey | 61/72.6 |
| 4,289,424 | 9/1981 | Shefbuch et al. | 405/179 |
| 4,332,511 | 6/1982 | Bradley et al. | 405/178 |
| 4,650,370 | 3/1987 | Kassner et al. | 405/183 |
| 4,666,337 | 5/1987 | Pinto | 405/179 X |
| 4,741,646 | 5/1988 | Hatch | 405/175 |
| 4,812,078 | 3/1989 | Rivard | 405/179 |
| 4,912,862 | 4/1990 | Bishop et al. | 37/142.5 |
| 4,955,756 | 9/1990 | Klamar | 405/179 |
| 4,981,396 | 1/1991 | Albertson et al. | 405/178 |
| 5,082,397 | 1/1992 | Raviv | 405/176 |
| 5,261,171 | 11/1993 | Bishop | 37/152.5 |

FOREIGN PATENT DOCUMENTS

| | | | |
|---|---|---|---|
| 410900 | 5/1934 | United Kingdom | 405/157 |

*Primary Examiner*—Tamara L. Graysay
*Assistant Examiner*—Frederick L. Lagman
*Attorney, Agent, or Firm*—Buchanan Ingersoll, P.C.; Lynn J. Alstadt

[57] ABSTRACT

A ditch backfilling device and apparatus therefor are disclosed. In particular, the ditch backfilling device includes a mainframe for supporting a compartment for storing the backfill material and a screening system for sorting and directing the backfill material into a ditch. The backfilling device includes a support for holding a roll of warning tape and an application roller for placing the unrolled portion of the warning tape above a uniform structure, such as a pipeline, within a layer of backfill material in the ditch. The warning tape is thereafter buried in subsequent layers of backfill material poured by the backfilling device. The backfilling device also includes a guide structure which is configured to follow the surface of the uniform structure. The guide structure positions a conduit adjacent the uniform structure for burial in the backfill material. The conduit may contain cables for the transmission of communication information or operating instructions.

22 Claims, 3 Drawing Sheets

BACKFILLING DEVICE AND APPARATUS THEREFOR

BACKGROUND OF THE INVENTION

1. Field of the Invention

The present invention relates to ditch backfilling devices and apparatus therefor, and more particularly, to ditch backfilling devices and apparatus used to backfill ditches having a pipeline therein.

2. Description of the Prior Art

It is known that pipelines are used for transporting fluids, such as gas or oil, over long distances, and it is common practice to bury the pipelines in ditches for protection. The backfilling is usually carried out by replacing the soil taken from the ditch to be filled. A screening and backfilling device may be used to sort the backfill material and bury the pipeline. The backfilling device is usually carried over the ditch by a tractor which travels alongside the ditch.

A backfilling device of this type usually includes a storage hopper or similar compartment for receiving the backfill material, and a continuous conveyor and a system of vibrating screens for sorting the backfill material. The components within the backfilling device are supported by a mainframe which is carried above the ditch to be backfilled. A support arm rigidly locks the backfilling device with a tractor or other means of locomotion. The backfilling device is configured to backfill the ditch with various layers of different sized backfill material in a single pass.

Such a backfilling device is described in U.S. Pat. No. 4,955,756. In addition, numerous other alternatives exist within the market and the invention is naturally not limited to the device described within U.S. Pat. No. 4,955,756.

SUMMARY OF THE INVENTION

The present invention is meant to improve backfilling devices by enabling these devices to lay a continuous plastic tape, net or woven material above the pipeline to inform others that the pipeline is present as well as simultaneously position a tubular conduit laterally on the side of the pipeline for burial in the ditch. The tubular conduit may contain one or more cables including fiber-optic cables for the transmission of information and control signals.

It is in fact usual to provide a continuous warning tape above pipelines installed in a ditch to inform individuals of the presence of the pipeline. In addition, it has become increasingly common to place conduits within ditches which house pipelines to protect the cables without incurring substantial additional costs.

The warning tape and the cable conduit are presently manually placed in the ditch by laborers.

The present invention is aimed to automate the above identified procedures by offering a ditch backfilling device which is equipped with appropriate means to install a warning tape and/or cable conduit without the intervention of laborers.

The presently preferred ditch backfilling device includes a mainframe capable of traveling above the ditch by means of a locomotion device. The mainframe supports a compartment for storing the backfill material and a screening means for sorting and pouring the backfill material into the ditch.

The mainframe of the backfilling device may further include a support positioned below the backfill material screening means in the traveling direction of the backfilling device. The support is configured to hold a roll of warning tape and permit the warning tape to unroll onto a layer of backfill material. The support may include a first shaft positioned between a pair of arms which are attached to the mainframe. The roll of warning tape is placed onto the first shaft for support.

The backfilling device and apparatus therefor may further include an application roller mounted below the mainframe and above the unrolled warning tape for applying the warning tape onto a layer of backfill material above the pipeline.

The warning tape will be continuously applied by the application roller against the backfill material above the pipeline. The warning tape is subsequently covered by an additional layer of backfill material after it is placed above the pipeline. All layers of backfill material may be simultaneously poured by the device according to known methods in the art.

The device may further include a scraper knife fixed to the pair of arms for leveling a layer of backfill material. The application roller may be attached to the pair of arms at a position behind the scraper knife in a travelling direction of the backfilling device such that the warning tape will be applied on a leveled layer of backfill material. The scraper knife and the application roller are preferably adjustable in height in relation to the mainframe by means of a cylinder system or similar device.

The backfilling device and apparatus therefor may further include means for guiding the backfilling device. The means may include a support beam attached at one end to the mainframe and a chain suspended at the other end of the support beam. The tractor operator may guide the backfilling device along the ditch by maintaining the end of the chain in constant contact with the upper part of the pipeline. In addition, the distance between the support beam and the pipeline may vary on grades. Therefore, the chain may be utilized to monitor the distance between the backfilling device and the pipeline. The height of the scraper knife may thereafter be adjusted in order to maintain a uniform depth of backfill material around the pipeline. Other devices such as radar or a video camera may be utilized to enable the operator to monitor the distance of the backfilling device above the pipeline.

The device may further include a guide structure which corresponds to the profile of a uniform structure such as a pipeline placed within the ditch. The guide structure includes at least one guide ring laterally connected thereto. A cable conduit located within the ditch may be placed within the guide ring as the guide structure and backfilling device travel in a forward direction. The guide structure and guide ring hold the conduit located therein at a constant distance from the pipeline. The conduit is thereafter buried in this position within backfill material poured into the ditch.

The backfilling device and apparatus therefor permit the advantageous functions described herein to be automatically and simultaneously performed in synchronization with the usual backfilling functions.

A preferred embodiment of the invention will be described hereinafter with reference to the enclosed drawings.

DETAILED DESCRIPTION OF THE PREFERRED EMBODIMENTS

As used hereinafter, the term backfilling device will refer to a backfilling device equipped with the apparatus in accordance with the present invention.

Figure 1:
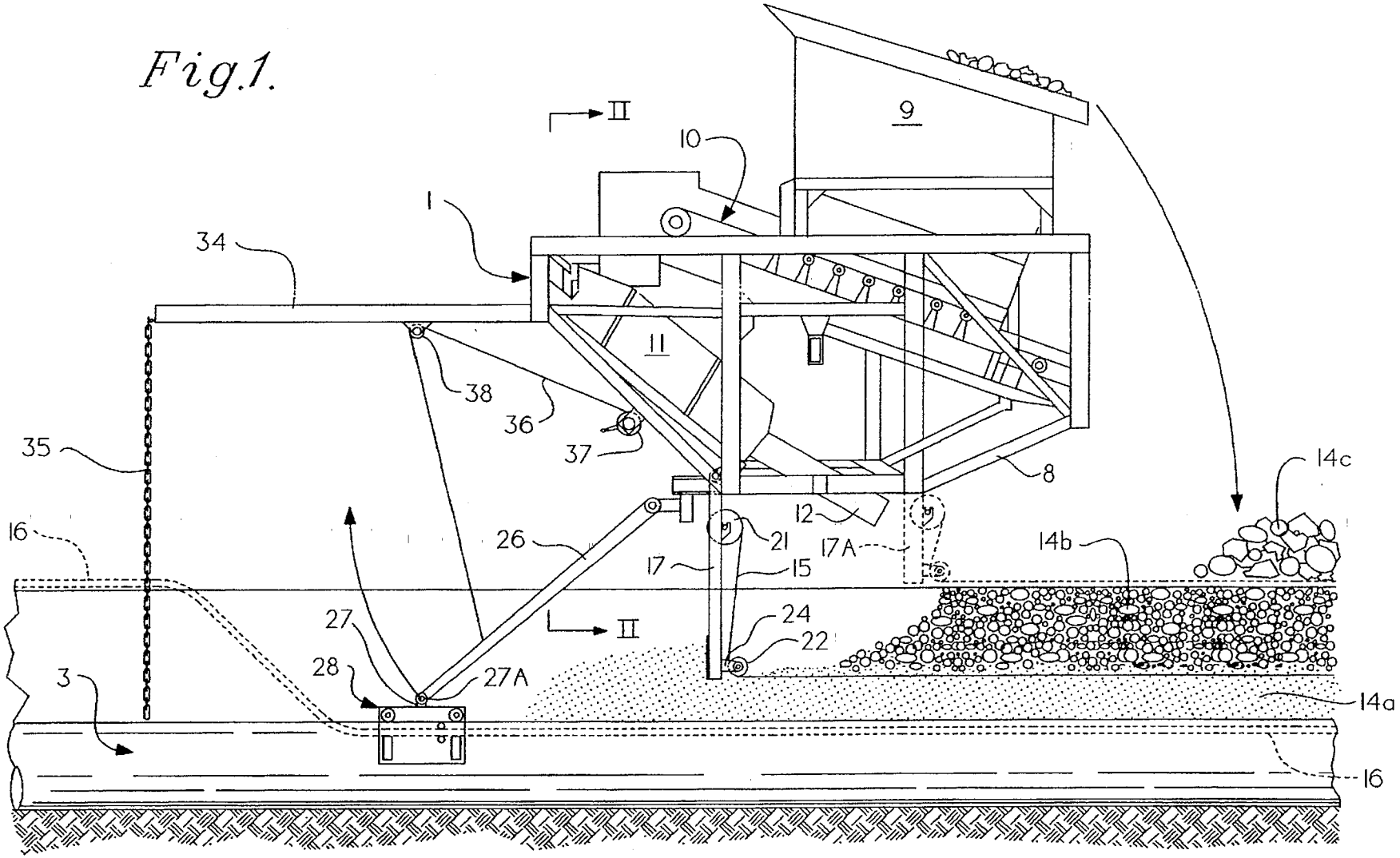
FIG. 1 is a side view of a backfilling device which utilizes the apparatus in accordance with the invention to apply the warning tape above the pipeline and position the conduit apart from the pipeline while backfilling the ditch.
Figure 2:
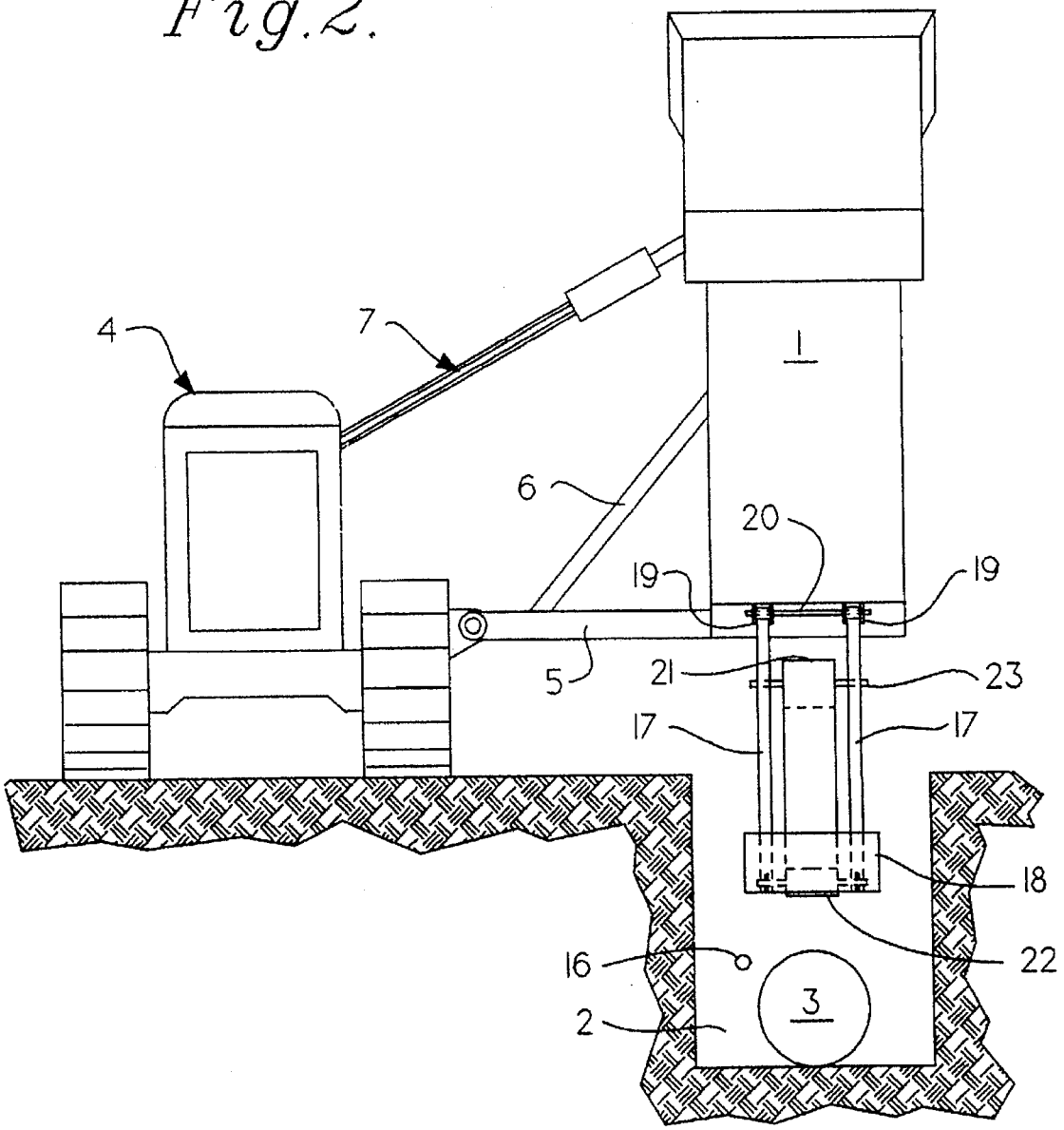
FIG. 2 is sectional view taken along the line II in FIG. 1.

As the shown in FIGS. 1 and 2, the backfilling device 1 is placed above a ditch 2 which has a uniform structure such as a pipeline 3 located therein. The backfilling device 1 is carried by a tractor 4 or similar device which travels laterally alongside the ditch 2. The backfilling device 1 is rigidly connected to the tractor 4 by a plurality of articulated arms 5, 6 and a raising system 7 such as a cable or cylinder system.

The basic structure of the backfilling device 1 preferably is of the type described in U.S. Pat. No. 4,955,756, which is herein incorporated by reference. This structure includes a mainframe 8 for supporting a compartment 9. The compartment 9 receives the backfill material and subsequently pours it onto a continuous conveyer 10. The conveyor 10 distributes the backfill material onto a screening system 11.

The screening system 11 includes a plurality of vibrating screens for sorting the backfill material according to size. A first layer 14*a* of backfill material is relatively fine in size and is poured into the ditch 2 before a scraper knife 18 and an application roller 22 in a travelling direction of the backfilling device 1. Subsequent layers 14*b*, 14*c* of larger sized backfill material may be subsequently poured into the ditch by a spout 12 as depicted in FIG. 1. The first layer 14*a* of backfill material covers and protects the pipeline 3.

The backfilling device 1 may be configured to place a warning tape 15 between the layers 14 of backfill material for indicating the presence of the pipeline 3. In addition, the backfilling device 1 may be used to place a conduit 16 at a lateral position along the pipeline 3. Both functions of placing the warning tape 15 and placing the conduit 16 within the ditch 2 may be simultaneously carried out by the backfilling device 1.

As shown in FIGS. 1 and 2, the backfilling device 1 may include a plurality of arms 17 attached to the mainframe 8 via a plurality of U-shaped hooks 19 and a first shaft 20. The backfilling device 1 may further include a scraper knife 18 attached to said arms 17 for flattening a layer 14 of backfill material.

As shown in FIG. 2, a second shaft 23 may be located between the arms 17 for holding a roll 21 of warning tape 15. The warning tape 15 positioned on the second shaft 23 may unroll freely behind the scraper knife 18 as the backfilling device travels above the ditch 2.

The backfilling device 1 may further include an application roller 22 attached to the scraper knife 18 by at least one mounting arm 24. The application roller 22 applies the warning tape 15 onto a layer 14 of backfill material. As shown in FIG. 1, the proximity of the application roller 22 to the layers 14 of backfill material allows the backfilling device 1 to place the warning tape 15 directly above the pipeline 3 on a first layer 14*a* of backfill material for burial under subsequent layers 14*b*, 14*c* of backfill material. The application roller 22 prevents wind from affecting the placement of the warning tape 15.

The first layer 14*a* of backfill material is flattened by the scraper knife 18 as the backfilling device 1 travels along the ditch 2. Simultaneously, the warning tape 15 unrolls from the roll 21 and is applied by the application roller 22 to the first layer 14*a* of backfill material. Alternatively, the arms 17 may be located in position 17A as shown in FIG. 1 and the warning tape 15 may be placed between the subsequent layers 14*b*, 14*c* of backfill material.

Figure 3:
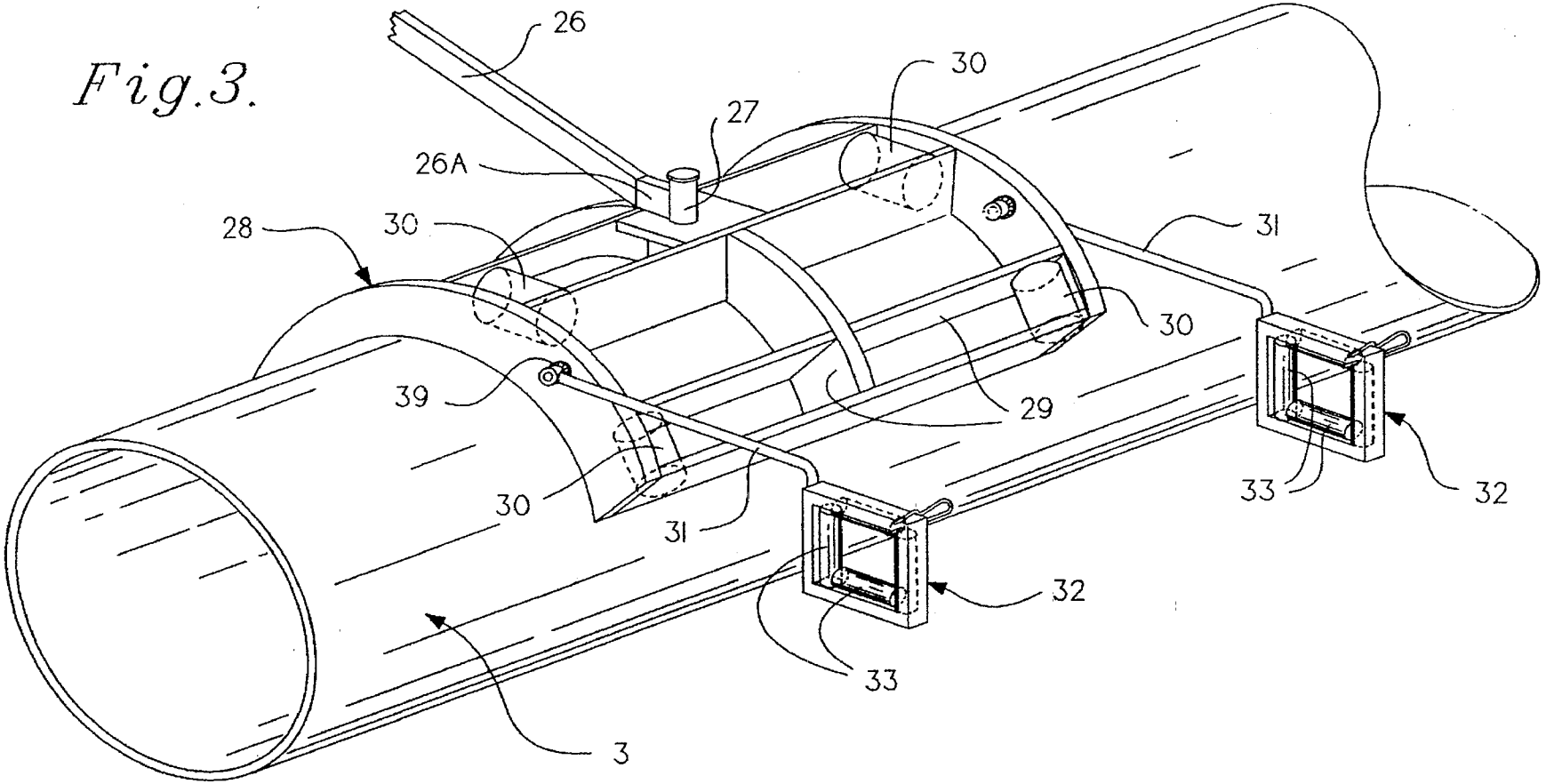
FIG. 3 is a perspective view of the guide structure in accordance with the invention.

The backfilling device 1 may further include an elongated arm 26 pivotally mounted at a first end thereof to the front of the mainframe 8 in the travelling direction of the backfilling device 1. The elongated arm 26 supports at a second end thereof, by a vertical shaft 27 and a horizontal shaft 27A, a guide structure 28 which is shown in detail in FIG. 3.

The guide structure 28 includes a plurality of rails 29 which preferably form a profile corresponding to the surface of the uniform structure buried within the ditch 2. The guide structure 28 shown in FIG. 3 has a cylindrical profile which corresponds to a uniform structure having a curved outer surface such as a pipeline 3. The guide structure 28 includes a plurality of first rollers 30 mounted on the rails 29 for facilitating the movement of the guide structure 28 along the uniform structure or pipeline 3. The guide structure 28 may therefore follow the uniform structure or pipeline 3 within the ditch 2 as the mainframe 8 advances along the ditch 2.

The guide structure 28 also includes at least one guide ring 32. Each guide ring 32 has an opening therein for allowing the passage of the conduit 16 therethrough for positioning the conduit 16 adjacent the pipeline 3. The guide structure 28 includes at least one lateral arm 31 for coupling each guide ring 32 with the guide structure 28. Each lateral arm 31 is attached to the guide structure 28 by a rotatable coupling 39. The rotatable coupling 39 may include a ratchet or set screw for locking each lateral arm 31 and guide ring 32 into a fixed position. Each guide ring 32 includes a plurality of second rollers 33 for facilitating the passage of the conduit 16 through each guide ring 32.

As the mainframe 8 advances, each guide ring 32 holds the conduit 16 at a constant position adjacent the pipeline 3. The conduit 16 is immediately buried by the layers 14 of backfill material poured by the mainframe 8. As shown in FIG. 2, the conduit 16 is preferably positioned along the side of the pipeline thereby allowing access to either the conduit 16 or the pipeline 3 with minimal disturbance to the other.

The entire operation of installing the conduit 16 in the ditch 2 is completed in synchronization with the other operations of the backfilling device 1.

The backfilling device 1 preferably includes a support beam 34 attached at a first end thereof to the mainframe 8 as shown in FIG. 1. A chain 35 may be attached to a second end of the support beam 34. The chain 35 is a preselected length such that its free end touches the upper surface of the pipeline 3 and may therefore be used to guide the backfilling device 1. In particular, the operator of the tractor 4 maintains the chain 35 above the pipeline 3 for proper lateral alignment of the backfilling device 1.

The distance between the pipeline 16 and the support beam 34 may also vary depending upon the grade. Therefore, the chain 35 may be monitored to indicate a variation in the distance between the support beam 34 and the pipeline 16. The height of the arms 17 and the scraper knife 18 may be vertically adjusted when the distance is varied to maintain a constant depth of backfill material. Alternative devices such as radar or a video camera may also be utilized to permit the operator of the backfilling device 1 to monitor the distance between the backfilling device 1 and the pipeline 16.

The backfilling device 1 may further include a winch 37 connected to the mainframe 8 and a cable 36 attached to the winch 37. The cable 36 passes through a return pulley 38 and is attached to the elongated arm 26. The winch 37 and cable 36 may be utilized to adjust the height of the elongated arm 26 and guide structure 28 when necessitated by the operating environment or either the guide structure 28 or the backfilling device 1 is not in use.

The backfilling device 1 may further include a cylinder system coupled with the mainframe 8 and arms 17 for permitting vertical adjustment of the scraper knife 18 and the application roller 22. The operator of the backfilling device 1 may maintain uniform layers 14 of backfill material through adjustment of the scraper knife 18.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting to the scope of the invention which is to be given the full breadth of the following claims and all equivalents thereof.

We claim:

1. An apparatus attachable to a backfilling device for positioning a conduit adjacent a uniform structure within a ditch being backfilled, comprising:

a. an elongated arm attached to the backfilling device;

b. a guide structure coupled with said elongated arm and being configured to follow the uniform structure as the device travels along the ditch; and c. at least one guide ring attached to said guide structure and spaced therefrom and said at least one guide ring has an opening therein for allowing the passage of the conduit therethrough.

2. The apparatus of claim 1 further comprising at least one lateral arm for coupling said at least one guide ring with said guide structure and permitting adjustment of said at least one guide ring.

3. The apparatus of claim 2 wherein said guide structure includes a plurality of rails which define a profile corresponding to an outer surface of the uniform structure.

4. The apparatus of claim 3 further comprising a plurality of first rollers attached to the rails and said first rollers for facilitating the movement of said guide structure on the uniform structure.

5. The apparatus of claim 4 further comprising a plurality of second rollers attached to said at least one guide ring for facilitating the movement of the conduit therethrough.

6. The apparatus of claim 5 wherein the uniform structure is a pipeline.

7. A device for backfilling a ditch and installing a conduit therein, comprising:

a. a mainframe having a compartment for storing a backfill material and a screen system for sorting and directing the backfill material into the ditch;

b. an elongated arm attached to said mainframe;

c. a guide structure coupled with said elongated arm and being configured to follow a uniform structure positioned within the ditch; and d. at least one guide ring attached to said guide structure and spaced therefrom and said at least one guide ring has an opening therein for allowing the passage of the conduit therethrough.

8. The device of claim 7 further comprising at least one lateral arm for coupling said at least one guide ring with said guide structure and permitting adjustment of said at least one guide ring.

9. The device of claim 8 wherein said guide structure includes a plurality of rails which define a profile corresponding to an outer surface of the uniform structure.

10. The device of claim 9 further comprising a plurality of first rollers attached to the rails and said first rollers for facilitating the movement of said guide structure on the uniform structure.

11. The device of claim 10 further comprising a plurality of second rollers attached to said at least one guide ring for facilitating the movement of the conduit therethrough.

12. The device of claim 11 wherein the uniform structure is a pipeline.

13. The device of claim 12 further comprising a winch attached to said mainframe and a first cable attached to said winch at a first end thereof and said elongated arm at a second end thereof and said winch and said first cable for adjusting the position of said guide structure.

14. The device of claim 13 further comprising a support beam attached at a first end thereof to said mainframe and a second cable attached to a second end of said support beam and said second cable for orienting the device with the pipeline.

15. A device for backfilling a ditch having a uniform structure therein and for positioning a conduit adjacent the uniform structure, comprising:

a. a mainframe having a compartment for storing a backfill material and a screen system for sorting and directing the backfill material into the ditch;

b. a support attached to said mainframe for holding a roll of warning tape and permitting the rotation thereof;

c. a scraper knife attached to said mainframe for leveling a first layer of the backfill material;

d. an application roller attached to said scraper knife for uniformly placing an unrolled portion of the warning tape on the first layer of backfill material at a preselected position;

e. an elongated arm attached to said mainframe;

f. a guide structure coupled with said elongated arm and being configured to follow the uniform structure; and g. at least one guide ring attached to said guide structure and spaced therefrom and said at least one guide ring has an opening therein for allowing the passage of the conduit therethrough.

16. The device of claim 15 wherein said screen system directs a first layer of backfill material onto the uniform structure on a first side of said scraper knife and said application roll and said screen system directs a subsequent layer of backfill material onto the first layer of backfill material on a second side of said scraper knife and said application roll.

17. The device of claim 15 further comprising at least one lateral arm for coupling said at least one guide ring with said guide structure and permitting adjustment of said at least one guide ring.

18. The device of claim 17 wherein said guide structure includes a plurality of rails which define a profile corresponding to an outer surface of the uniform structure.

19. The device of claim 18, further comprising a plurality of first rollers attached to the rails and said first rollers for facilitating the movement of said guide structure on the uniform structure.

20. The device of claim 19 further comprising a plurality of second rollers attached to said at least one guide ring for facilitating the movement of the conduit therethrough.

21. The device of claim 20 further comprising a winch attached to said mainframe and a first cable attached to said winch at a first end thereof and said elongated arm at a second end thereof and said winch and said first cable for adjusting the position of said guide structure.

22. The device of claim 21 further comprising a support beam attached at a first end thereof to said mainframe and a second cable attached to a second end of said support beam and said second cable for orienting the device with the pipeline.

* * * * *